US008607597B2

(12) United States Patent
Ryu et al.

(10) Patent No.: US 8,607,597 B2
(45) **Date of Patent: *Dec. 17, 2013**

(54) WASHING MACHINE HAVING BALANCER

(75) Inventors: Doo Young Ryu, Suwon-si (KR); Ja Young Kim, Suwon-si (KR); Ito Michiaki, Suwon-si (KR); Myung Sun Kang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/137,328

(22) Filed: Aug. 5, 2011

(65) Prior Publication Data

US 2011/0289982 A1 Dec. 1, 2011

Related U.S. Application Data

(60) Continuation of application No. 13/064,987, filed on Apr. 29, 2011, which is a continuation of application No. 12/801,952, filed on Jul. 2, 2010, now Pat. No. 7,942,026, which is a continuation of application No. 12/659,980, filed on Mar. 26, 2010, now Pat. No. 7,797,970, which is a division of application No. 11/806,245, filed on May 30, 2007, now Pat. No. 7,743,633.

(30) Foreign Application Priority Data

Jun. 1, 2006 (KR) ..... 2006-49482
Jun. 1, 2006 (KR) ..... 2006-49501

(51) Int. Cl.
*D06F 25/00* (2006.01)

(52) U.S. Cl.
USPC ..... 68/23.2; 68/3 R; 68/12.06; 68/23.1; 68/140

(58) Field of Classification Search
USPC ..... 68/3 R, 12.06, 23.1, 23.2, 140
See application file for complete search history.

(56) References Cited

U.S. PATENT DOCUMENTS 2,984,094 A 5/1961 Belaieff et al.
4,044,626 A 8/1977 Hayashi et al.

(Continued)

FOREIGN PATENT DOCUMENTS

WO WO 99/50495 10/1999

OTHER PUBLICATIONS

U.S. Final Office Action dated Feb. 22, 2010, issued in the file history of U.S. Appl. No. 11/806,245.

(Continued)

*Primary Examiner* — Michael Barr
*Assistant Examiner* — Benjamin L Osterhout
(74) *Attorney, Agent, or Firm* — Staas & Halsey LLP

(57) ABSTRACT

A drum type washing machine including a housing, a spin tub, and a ball balancer coupled to the spin tub, the ball balancer including a first plastic member and a second plastic member joined to each other to form an annular-shaped race, the first plastic member including a first side wall, a second side wall and a connecting wall to form a three-sided annular-shaped structure having an open side, and the second plastic member adapted to cover the open side, the three-sided annular-shaped structure having a U-shaped cross-section with a first rounded inside corner formed between the first side wall and the connecting wall and a second rounded inside corner formed between the second side wall and the connecting wall. A radius of curvature of each of the first and second rounded inside corners is greater than a radius of curvature of opposite diagonal inside corners of the annular-shaped race.

17 Claims, 10 Drawing Sheets

(56) References Cited

U.S. PATENT DOCUMENTS

| | | | | |
|---|---|---|---|---|
| 4,433,592 | A | 2/1984 | Tatsumi et al. | |
| 5,802,885 | A * | 9/1998 | Kim | 68/23.2 |
| 5,850,748 | A * | 12/1998 | Kim et al. | 68/23.2 |
| 5,850,749 | A * | 12/1998 | Kim | 68/23.2 |
| 5,855,127 | A | 1/1999 | Kohara et al. | |
| 5,857,360 | A | 1/1999 | Kim et al. | |
| 5,906,756 | A * | 5/1999 | Lee et al. | 219/117.1 |
| 5,916,274 | A | 6/1999 | Lee et al. | |
| 6,119,547 | A * | 9/2000 | Goransson et al. | 74/572.4 |
| 6,122,843 | A | 9/2000 | Noguchi et al. | |
| 6,442,782 | B1 | 9/2002 | Vande Haar | |
| 6,550,292 | B1 | 4/2003 | Southworth et al. | |
| 6,578,225 | B2 | 6/2003 | Jonsson | |
| 6,658,902 | B2 * | 12/2003 | Southworth et al. | 68/23.2 |
| 6,741,544 | B1 | 5/2004 | Naka et al. | |
| 2005/0274159 | A1 | 12/2005 | Jeon et al. | |

OTHER PUBLICATIONS

U.S. Notice of Allowance dated Apr. 28, 2010 issued in the file history of U.S. Appl. No. 11/806,245.
U.S. Notice of Allowance dated May 27, 2010, issued in the file history of U.S. Appl. No. 12/659,980.
U.S. Office Action dated Oct. 15, 2010, issued in the file history of U.S. Appl. No. 12/801,952.
U.S. Notice of Allowance dated Feb. 23, 2011, issued in the file history of U.S. Appl. No. 12/801,952.
U.S. Office Action dated Jun. 8, 2011, issued in the file history of U.S. Appl. No. 13/064,987.
U.S. Office Action dated Jul. 25, 2011, issued in the file history of U.S. Appl. No. 13/064,590.
European Search Report dated Jan. 13, 2012 issued in related European Patent Application No. 11008529.7.
Office Action issued in co-pending U.S. Appl. No. 13/064,590 mailed, Dec. 7, 2011.
Office Action issued in co-pending U.S. Appl. No. 13/064,987 mailed, Dec. 2, 2011.
Office Action issued in co-pending U.S. Appl. No. 13/137,268 mailed, Oct. 4, 2011.
Office Action issued in co-pending U.S. Appl. No. 13/137,355 mailed, Oct. 4, 2011.
U.S. Office Action in copending U.S. Appl. No. 13/064,590 dated Aug. 1, 2012.
Extended European Search Report dated Mar. 1, 2012 issued in related European Patent Application No. 11008530.5.
Extended European Search Report dated Mar. 5, 2012 issued in related European Patent Application No. 1108921.6.
U.S. Office Action in copending U.S. Appl. NO. 13/064,987 dated Jun. 11, 2012.
U.S. Office Action in copending U.S. Appl. No. 13/137,268 dated Jun. 20, 2012.
U.S. Office Action in copending U.S. Appl. No. 13/137,355 dated May 1, 2012.
U.S. Office Action mailed Oct. 16, 2012 issued in the corresponding U.S. Appl. No. 13/402,282.
European Search Report for corresponding European Patent Application No. 11008528.9-2314 / 241 2412865 dated Sep. 21, 2012.
US Office Action mailed Nov. 26, 2012 issued in the copending U.S. Appl. No. 13/064,590.
U.S. Office Action issued Feb. 14, 2013 in copending U.S. Appl. No. 13/137,268.
U.S. Office Action mailed Sep. 25, 2012 issued in corresponding U.S. Appl. No. 13/137,355.
U.S. Notice of Allowance issued Jun. 17, 2013 in copending U.S. Appl. No. 13/402,282.
U.S. Notice of Allowance issued Mar. 21, 2013 in copending U.S. Appl. No. 13/064,590.
U.S. Office Action mailed Mar. 5, 2013 in copending U.S. Appl. No. 13/064,987.
U.S. Office Action issued Apr. 12, 2013 in copending U.S. Appl. No. 13/137,355.
U.S. Notice of Allowance issued Aug. 19, 2013 in copending U.S. Appl. No. 13/137,268.
U.S. Notice of Allowance issued Aug. 19, 2013 in copending U.S. Appl. No. 13/137,355.
U.S. Office Action issued Oct. 8, 2013 in copending U.S. Appl. No. 13/064,987.

* cited by examiner

WASHING MACHINE HAVING BALANCER

CROSS-REFERENCE TO RELATED APPLICATIONS

This application is a continuation application of U.S. application Ser. No. 13/064,987, filed Apr. 29, 2011, which was a continuation of U.S. application Ser. No. 12/801,952, filed Jul. 2, 2010, which was a continuation of U.S. application Ser. No. 12/659,980, filed Mar. 26, 2010, which issued as U.S. Pat. No. 7,797,970, which was a divisional of U.S. application Ser. No. 11/806,245, filed May 30, 2007, which issued as U.S. Pat. No. 7,743,633, which in turn claims the benefit of Korean Patent Application Nos. 2006-49501 and 2006-49482, both filed on Jun. 1, 2006, in the Korean Intellectual Property Office, the disclosures of which are incorporated herein by reference.

BACKGROUND

1. Field

The present invention relates generally to a washing machine having at least one balancer, and more particularly to a washing machine having at least one balancer that increases durability by reinforcing strength and that is installed on a rotating tub in a convenient way.

2. Description of the Related Art

In general, washing machines do the laundry by spinning a spin tub containing the laundry by driving the spin tub with a driving motor. In a washing process, the spin tub is spun forward and backward at a low speed. In a dehydrating process, the spin tub is spun in one direction at a high speed.

When the spin tub is spun at a high speed in the dehydrating process, if the laundry leans to one side without uniform distribution in the spin tub or if the laundry leans to one side by an abrupt acceleration of the spin tub in the early stage of the dehydrating process, the spin tub undergoes a misalignment between the center of gravity and the center of rotation, which thus causes noise and vibration. The repetition of this phenomenon causes parts, such as a spin tub and its rotating shaft, a driving motor, etc., to break or to undergo a reduced life span.

Particularly, a drum type washing machine has a structure in which the spin tub containing laundry is horizontally disposed, and when the spin tub is spun at a high speed when the laundry is collected on the bottom of the spin tub by gravity in the dehydrating process, the spin tub undergoes a misalignment between the center of gravity and the center of rotation, thus resulting in a high possibility of causing excess noise and vibration.

Thus, the drum type washing machine is typically provided with at least one balancer for maintaining a dynamic balance of the spin tub. A balancer may also be applied to an upright type washing machine in which the spin tub is vertically installed.

An example of a washing machine having ball balancers is disclosed in Korean Patent Publication No. 1999-0038279. The ball balancers of a conventional washing machine include racers installed on the top and the bottom of a spin tub in order to maintain a dynamic balance when the spin tub is spun at a high speed, and steel balls and viscous oil are disposed within the racers to freely move in the racers.

Thus, when the spin tub is spun without maintaining a dynamic balance due to an unbalanced eccentric structure of the spin tub itself and lopsided distribution of the laundry in the spin tub, the steel balls compensate for this imbalance, and thus the spin tub can maintain the dynamic balance.

However, the ball balancers of the conventional washing machine have a structure in which upper and lower plates formed of plastic by injection molding are fused to each other, and a plurality of steel balls are disposed between the fused plates to make a circular motion, so that the ball balancers are continuously supplied with centrifugal force that is generated when the steel balls make a circular motion, and thus are deformed at walls thereof, which reduces the life span of the balancer.

Further, the ball balancers of the conventional washing machine do not have a means for guiding the ball balancers to be installed on the spin tub in place, so that it takes time to assemble the balancers to the spin tub.

In addition, the ball balancers of the conventional washing machine have a structure in which a racer includes upper and lower plates fused to each other, so that fusion scraps generated during fusion fall down both inwardly and outwardly of the racer. The fusion scraps that fall down inwardly of the racer prevent motion of the balls in the racer, and simultaneously result in generating vibration and noise.

SUMMARY

Accordingly, the present invention has been made to solve the above-mentioned problems occurring in the prior art, and an object of the present invention is to provide a washing machine having at least one balancer that increases durability by reinforcing the strength of the balancer, which is installed on a rotating tub in a rapid and convenient way.

Another object of the present invention is to provide a washing machine having at least one balancer, in which fusion scraps generated by fusion of the balancer are prevented from falling down inward and outward of the balancer.

Additional aspects and/or advantages of the invention will be set forth in part in the description which follows and, in part, will be apparent from the description, or may be learned by practice of the invention.

In order to accomplish these objects, according to an aspect of the present invention, there is provided a washing machine having a spin tub to hold laundry to be washed and at least one balancer. The balancer includes first and second housings, the first housing having at least one support for reinforcing a strength of the balancer. The first and second housings have an annular shape and are fused together to form a closed internal space.

Here, the first housing may have the cross section of an approximately "C" shape, and the support protrudes outwardly from at least one of opposite walls of the first housing.

Further, the spin tub may include at least one annular recess corresponding to the balancer such that the balancer is able to be coupled to the spin tub by being fitted within the recess.

Further, the support may protrude from the first housing and comes into contact with a wall of the recess, and guides the balancer to be maintained in the recess in place.

Also, the supports may be continuously formed along and perpendicular to the opposite walls of the first housing.

Further, the supports may be disposed parallel to the opposite walls of the first housing at regular intervals.

Meanwhile, the washing machine may be a drum type washing machine. A front member may be attached to a front end of the spin tub and a rear member may be attached to a rear end of the spin tub. The recesses may be provided at the front and rear members of the spin tub, and the balancers may be coupled to opposite ends of the spin tub at the recesses of the front and rear members.

The foregoing and/or other aspects of the present invention can be achieved by providing a washing machine having at least one balancer. The balancer includes a first housing and a second housing fused to the first housing, and the first and second housings are fused together to form at least one pocket between the first housing and the second housing, the pocket capable of collecting fusion scraps generated during fusion.

Here, the first housing may include protruding fusion ridges protruding from ends of the first housing, and the second housing may include fusion grooves receiving the fusion ridges of the first housing when the first housing and the second housing are fused together.

Further, the first housing may further include inner pocket ridges protruding from the first housing and spaced inwardly apart with respect to the fusion ridges of the first housing.

Further, the second housing may further include outer pocket flanges protruding from the second housing and being situated on outer sides of the fusion grooves when the first housing is fused together with the second housing so the outer pocket flanges are spaced apart from the fusion ridges of the first housing by a predetermined distance, causing an outer pocket to be formed between the fusion ridges and the outer pocket flanges.

Further, the second housing may include guide ridges protruding from the second housing and protruding toward the first housing to closely contact the inner pocket ridges of the first housing when the first and second housings are fused together.

Also, the balancer may further include a plurality of balls disposed within an internal space formed by fusing the first and second housings together, the balls performing a balancing function.

In addition, the washing machine may further include a spin tub disposed horizontally, and the balancers may be installed at front and rear ends of the spin tub.

BRIEF DESCRIPTION OF THE DRAWINGS

The above and other aspects, features and advantages of the present invention will be more apparent from the following detailed description of the embodiments, taken in conjunction with the accompanying drawings, in which.

DETAILED DESCRIPTION OF THE EMBODIMENTS

Figure 1:
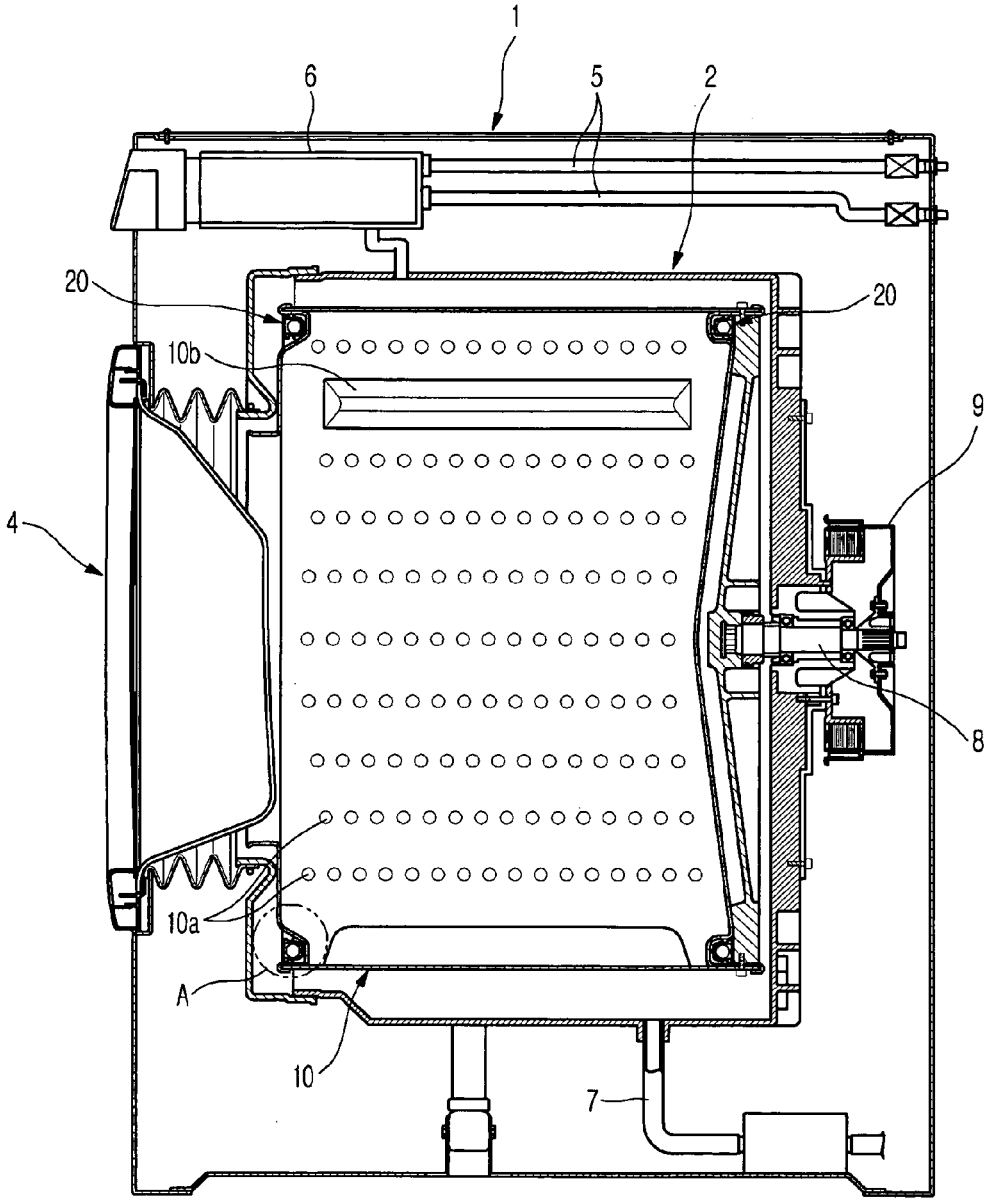
FIG. 1 is a sectional view illustrating a schematic structure of a washing machine according to the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, exemplary embodiments of the present invention will be described with reference to the attached drawings.

FIG. 1 is a sectional view illustrating the schematic structure of a washing machine according to the present invention.

As illustrated in FIG. 1, a washing machine according to the present invention includes a housing 1 forming an external structure of the washing machine, a water reservoir 2 installed in the housing 1 and containing washing water, a spin tub 10 disposed rotatably in the water reservoir 2 which allows laundry to be placed in and washed therein, and a door 4 hinged to an open front of the housing 1.

The water reservoir 2 has a feed pipe 5 and a detergent feeder 6 both disposed above the water reservoir 2 in order to supply washing water and detergent to the water reservoir 2, and a drain pipe 7 installed therebelow in order to drain the washing water contained in the water reservoir 2 to the outside of the housing 1 when the laundry is completely done.

The spin tub 10 has a rotating shaft 8 disposed at the rear thereof so as to extend through the rear of the water reservoir 2, and a driving motor 9, with which the rotating shaft 8 is coupled, installed on a rear outer side thereof. Therefore, when the driving motor 9 is driven, the rotating shaft 8 is rotated together with the spin tub 10.

The spin tub 10 is provided with a plurality of dehydrating holes 10*a* at a periphery thereof so as to allow the water contained in the water reservoir 2 to flow into the spin tub 10 together with the detergent to wash the laundry in a washing cycle, and to allow the water to be drained to the outside of the housing 1 through a drain pipe 7 in a dehydrating cycle.

The spin tub 10 has a plurality of lifters 10*b* disposed longitudinally therein. Thereby, as the spin tub 10 rotates at a low speed in the washing cycle, the laundry submerged in the water is raised up from the bottom of the spin tub 10 and then is lowered to the bottom of the spin tub 10, so that the laundry can be effectively washed.

Thus, in the washing cycle, the rotating shaft 8 alternately rotates forward and backward by of the driving of the driving motor 9 to spin the spin tub 10 at a low speed, so that the laundry is washed. In the dehydrating cycle, the rotating shaft 8 rotates in one direction to spin the spin tub 10 at a high speed, so that the laundry is dehydrated.

When spun at a high speed in the dehydrating process, the spin tub 10 itself may undergo misalignment between the center of gravity and the center of rotation, or the laundry may lean to one side without uniform distribution in the spin tub 10. In this case, the spin tub 10 does not maintain a dynamic balance.

In order to prevent this dynamic imbalance to allow the spin tub 10 to be spun at a high speed with the center of gravity and the center of rotation thereof matched with each other, the spin tub 10 is provided with balancers 20 or 30 according to a first or a second embodiment of the present invention (wherein only the balancer 20 according to a first embodiment is shown in FIGS. 1-4) at front and rear ends thereof. The structure of the balancers 20 and 30 according to the first and second embodiments of the present invention will be described with reference to FIGS. 2 through 6.

Figure 2:
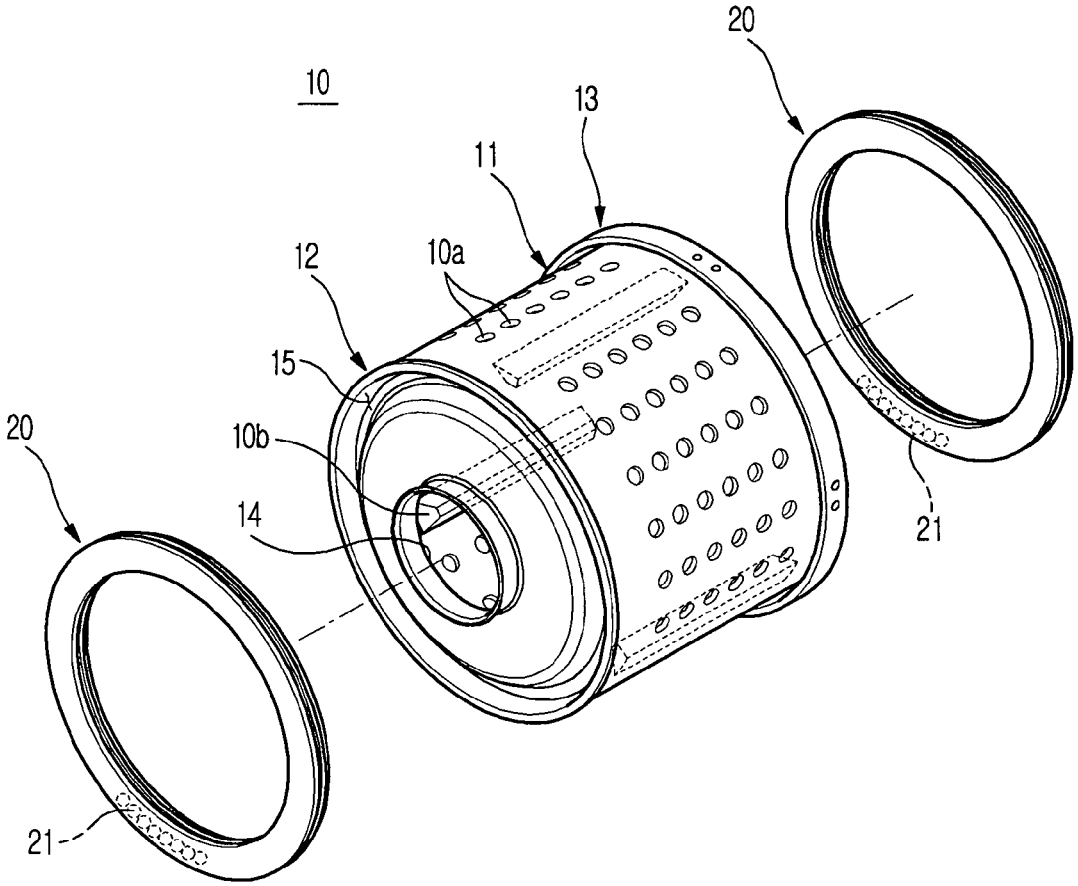
FIG. 2 is a perspective view illustrating balancers according to the present invention, in which the balancers are disassembled from a spin tub.

FIG. 2 is a perspective view illustrating balancers according to the present invention, in which the balancers are disassembled from a spin tub.

As illustrated in FIG. 2, the spin tub 10 includes a cylindrical body 11 that has open front and rear parts and is provided with the dehydrating holes 10*a* and lifters 10*b*, a front member 12 that is coupled to the open front part of the body 11 and is provided with an opening 14 permitting the laundry to be placed within or removed from the body 11, and a rear member 13 that is coupled to the open rear part of the body 11 and with the rotating shaft 8 (see FIG. 1) for spinning the spin tub 10.

The front member 12 is provided, at an edge thereof, with an annular recess 15 that has the cross section of an approximately "C" shape and is open to the front of the front member 12 in order to hold any one of the balancers 20. Similarly, the rear member 13 is provided, at an edge thereof, with an annular, recess 15 (not shown) that is open to the rear of the front member 12 in order to hold the other of the balancers 20.

The front and rear members 12 and 13 are fitted into and coupled to the front or rear edges of the body 11 in a screwed fashion or in any other fashion that allows the front and rear members 12 and 13 to be maintained to the body 11 of the spin tub 10.

The balancers 20, which are installed in the recesses 15 of the front and rear members 12 and 13, have an annular shape and are filled therein with a plurality of metal balls 21 performing a balancing function and a viscous fluid (not shown) capable of adjusting a speed of motion of the balls 21.

Now, the structure of the balancers 20 and 30 according to the first and second embodiments of the present invention will be described with reference to FIGS. 3 through 6.

Figure 3:
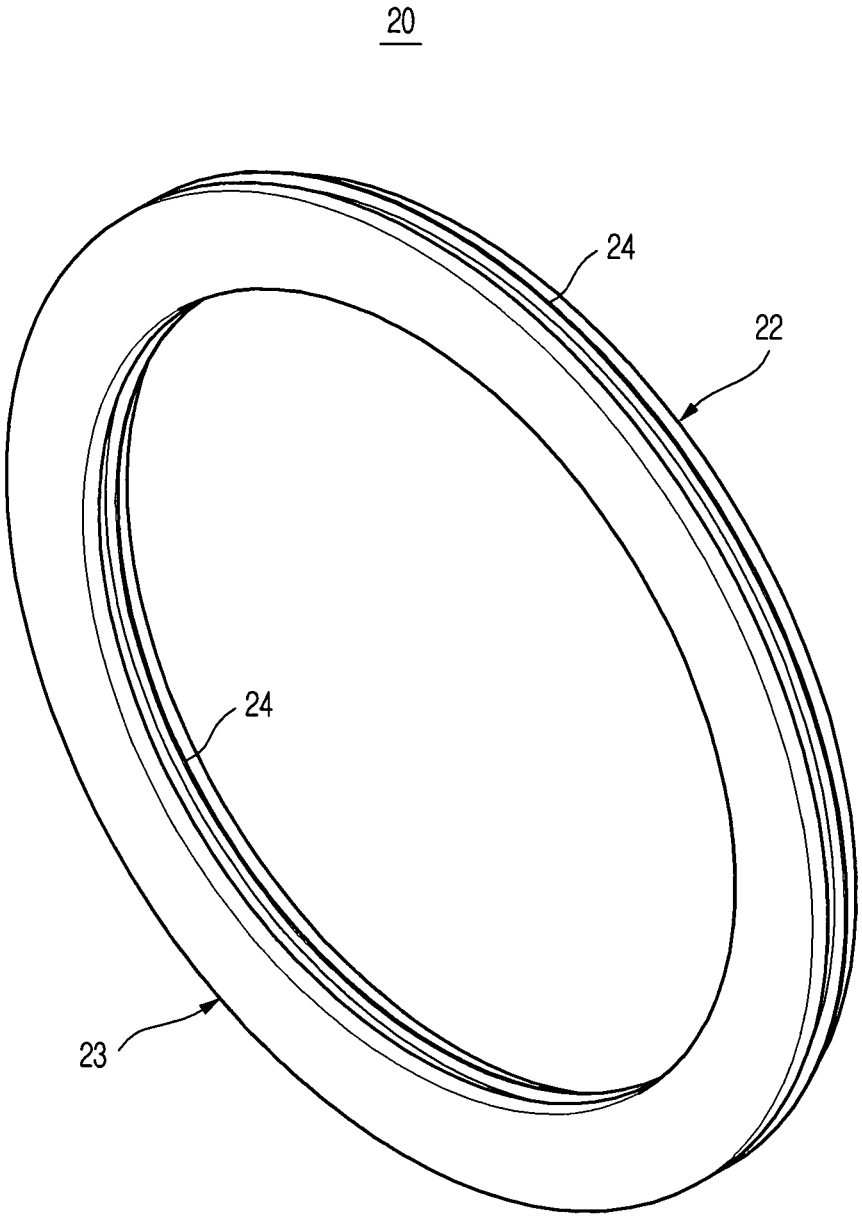
FIG. 3 is a perspective view illustrating a balancer according to a first embodiment of the present invention.
Figure 4:
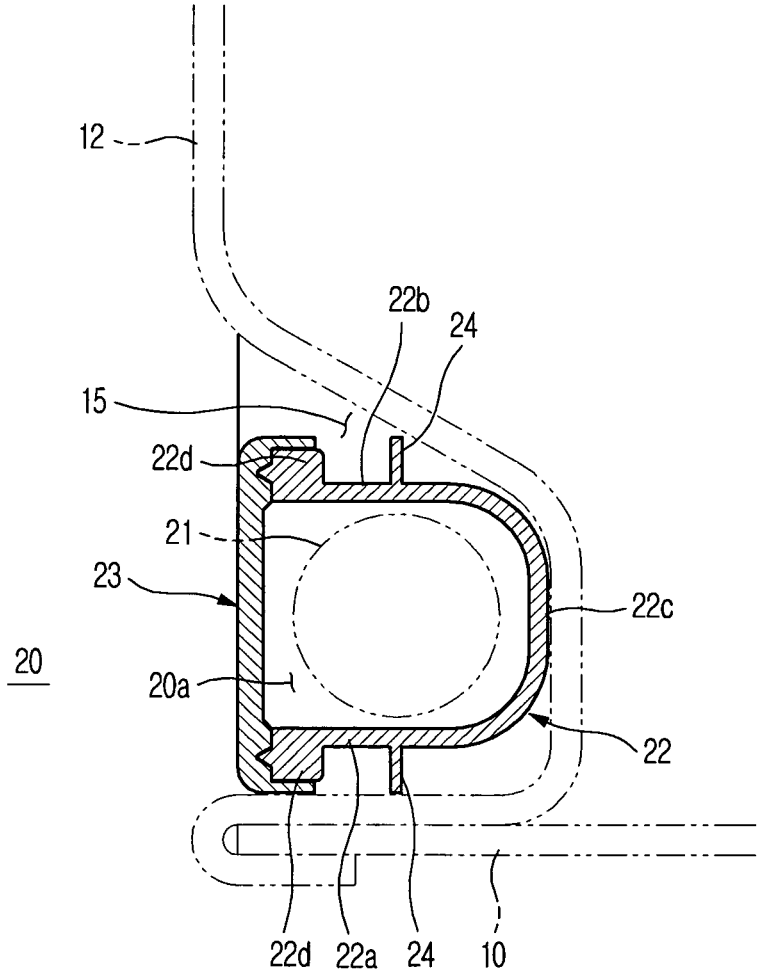
FIG. 4 is an enlarged view illustrating section A of FIG. 1 in order to show the sectional structure of a balancer according to a first embodiment of the present invention.

FIG. 3 is a perspective view illustrating a balancer according to a first embodiment of the present invention, and FIG. 4 is an enlarged view illustrating part A of FIG. 1 in order to show the sectional structure of a balancer according to a first embodiment of the present invention.

As illustrated in FIGS. 3 and 4, a balancer 20 according to a first embodiment of the present invention has an annular shape and includes first and second housings 22 and 23 that are fused to define a closed internal space 20*a*.

The first housing 22 has first and second walls 22*a* and 22*b* facing each other, and a third wall 22*c* connecting ends of the first and second walls 22*a* and 22*b*, and thus has a cross section of an approximately "C" shape. The second housing 23 has opposite edges that protrude toward the first housing 22 and that are coupled to corresponding opposite ends 22*d* of the first housing 22 by heat fusion.

The opposite ends 22*d* of the first housing 22 protrude outward from the first and second walls 22*a* and 22*b* of the first housing 22, and the edges of the second housing 23 are sized to cover the ends 22*d* of the first housing 22.

Thus, when the balancer 20 is fitted into the recess 15 of the front member 12 of the spin tub 10, the first and second walls 22*a* and 22*b* are spaced apart from a wall of the recess 15 because of the ends and edges of the first and second housings 22 and 23 which protrude outward from the first and second walls 22*a* and 22*b*. Further, because the first and second walls 22*a* and 22*b* are relatively thin, the first and second walls 22*a* and 22*b* are raised outward when centrifugal force is applied thereto by the plurality of balls 21 that move in the internal space 20*a* of the balancer 20 in order to perform the balancing function.

In this manner, the plurality of balls 21 make a circular motion in the balancer 20, so that the first and second walls 22*a* and 22*b* are deformed by the centrifugal force applied to the first and second walls 22*a* and 22*b* of the first housing 22. In order to prevent this deformation, the second housing 22 is provided with supports 24 according to a first embodiment of the present invention.

The supports 24 protrude from and perpendicular to the first and second walls 22*a* and 22*b* of the first housing 22 which are opposite each other, and may be continued along an outer surface of the first housing 22, thereby having an overall annular shape.

The supports 24 have a length such that they extend from the first housing 22 to contact the wall of the recess 15. Hence, the first and second walls 22*a* and 22*b* are further increased in strength, and additionally function to guide the balancer 20 so as to be maintained in the recess 15 in place.

Here, when the plurality of balls 21 make a circular motion in the first housing 22, the centrifugal force acts in the direction moving away from the center of rotation of the spin tub 10. Hence, the centrifugal force acts on the first wall 22*a* to a stronger level when viewed in FIG. 4. Thus, the supports 24 may be formed only on the first wall 22*a*.

In the balancer 20 according to the first embodiment of the present invention, when the first and second housings 22 and 23 are fused together and fitted into the recess 15 of the spin tub 10, the supports 24 are maintained in place while positioned along the wall of the recess 15. Finally, the balancer 20 is coupled and fixed to the front member 12 of the spin tub 10 by screws (not shown) or in any other fashion that allows the balancer 20 to be coupled to the front member 12.

Although not illustrated in detail, the balancer 20 is similarly installed on the rear member 13 of the spin tub 10.

The ends 22*d* of the first housing 22 include fusion ridges 42*a* that protrude toward the second housing 23. The fusion ridges 42*a* are inserted within fusion grooves 43*a* of the second housing 23.

Figure 5:
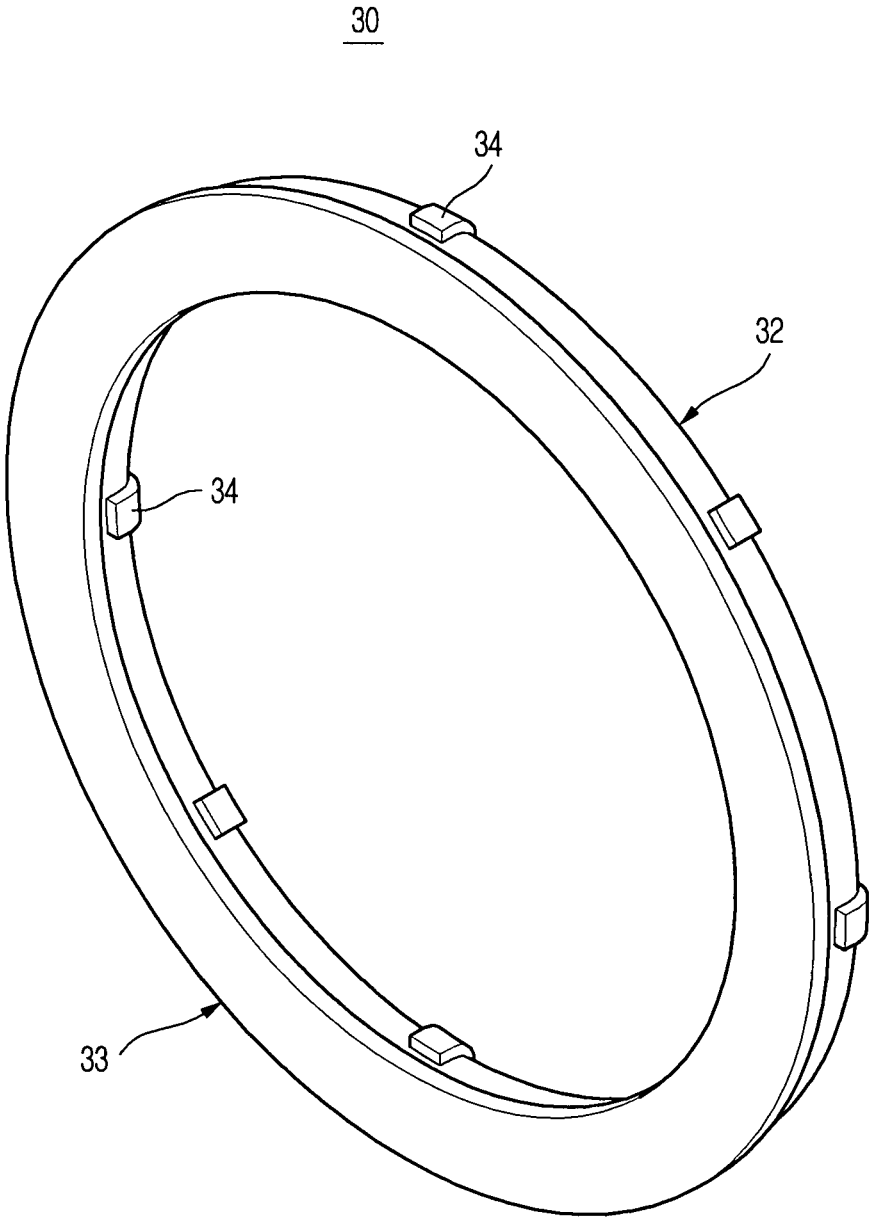
FIG. 5 is a perspective view illustrating a balancer according to a second embodiment of the present invention.
Figure 6:
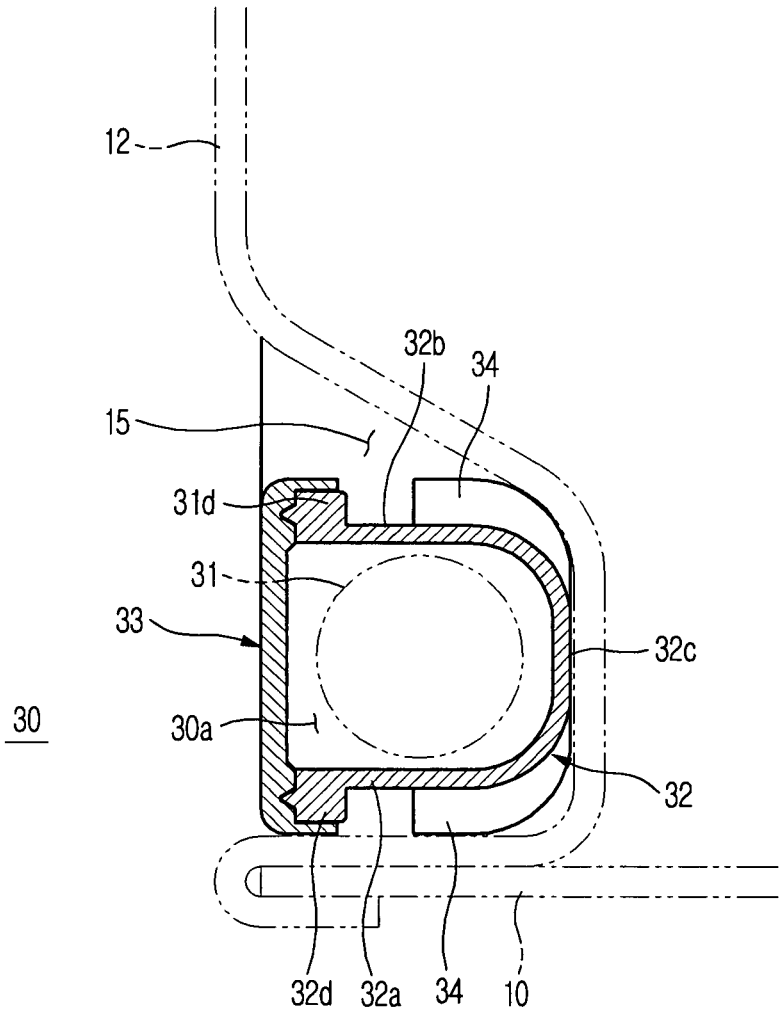
FIG. 6 is an enlarged view illustrating the sectional structure of a balancer according to the second embodiment of the present invention.

FIGS. 5 and 6 correspond to FIGS. 3 and 4, and illustrate a balancer 30 according to a second embodiment of the present invention.

The balancer 30 according to the second embodiment of the present invention has an annular shape and includes first and second housings 32 and 33 that are fused together forming an internal space 30*a* therebetween in which a plurality of balls 31 are disposed. The balancer 30 according to the second embodiment of the present invention is similar to that of balancer 20 according to the first embodiment of the present invention, except the structure of supports 34 of balancer 30 is different from that of the structure of the supports 24 of balancer 20.

As illustrated in FIGS. 5 and 6, the supports 34 according to the second embodiment of the present invention protrude parallel to first and second walls 32*a* and 32*b* of a first housing 32 which are opposite each other, and the supports 34 are disposed at regular intervals along the first and second walls 32*a* and 32*b*. The first housing 32 further includes a third wall 32*c*. Ends 22*d* of the first housing 32 extend from an end of the first and second walls 32*a* and 32*b*.

Similar to the supports 24 according to the first embodiment, the supports 34 of the second embodiment have a length such that the supports 34 extend from the first housing 32 to contact the wall of the recess 15. The surfaces of the supports 34 thereby abut portions of the front member 12. Hence, the first and second walls 32*a* and 32*b* are further increased in strength, and additionally function to guide the balancer 30 so as to be maintained in the recess 15 in place.

Next, the construction of a balancer 40 according to a third embodiment of the present invention will be described with reference to FIGS. 7 through 10.

Figure 7:
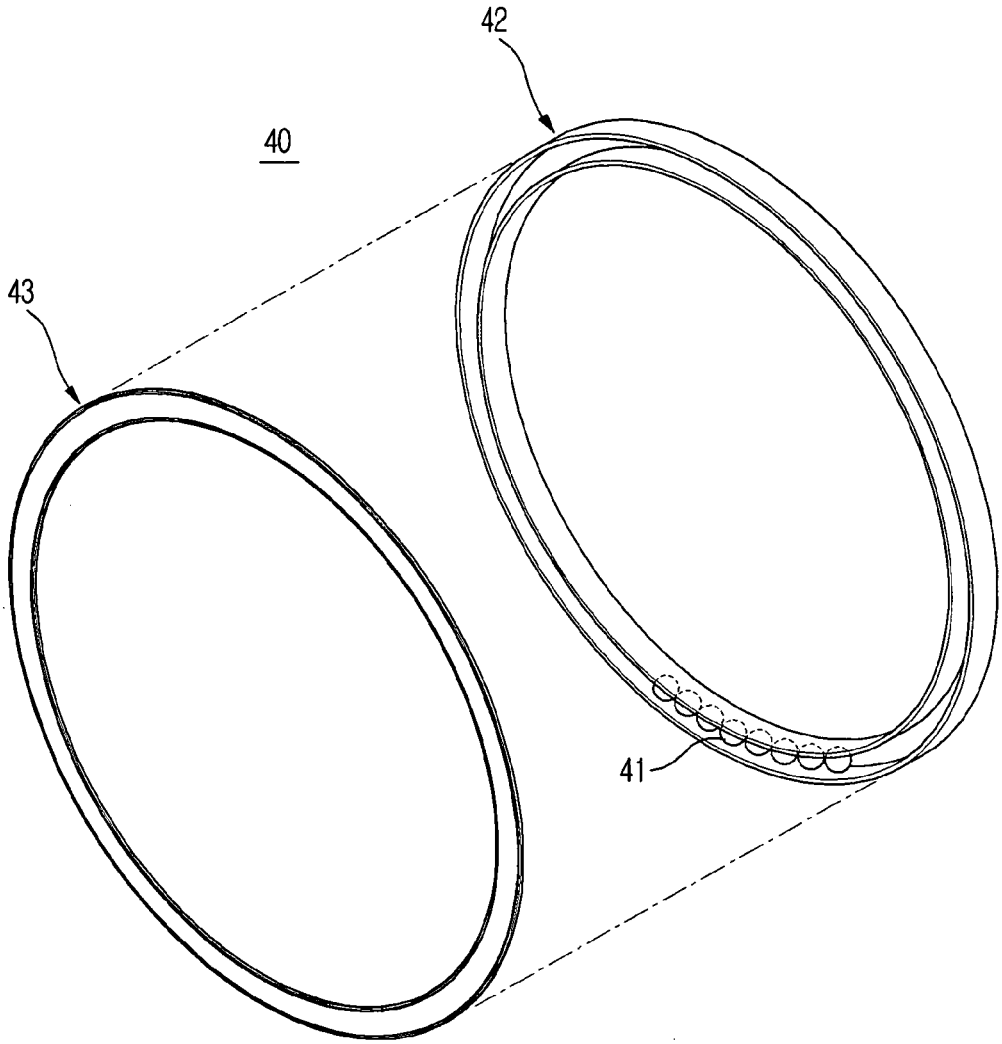
FIG. 7 is a perspective view illustrating a disassembled balancer according to a third embodiment of the present invention.
Figure 8:
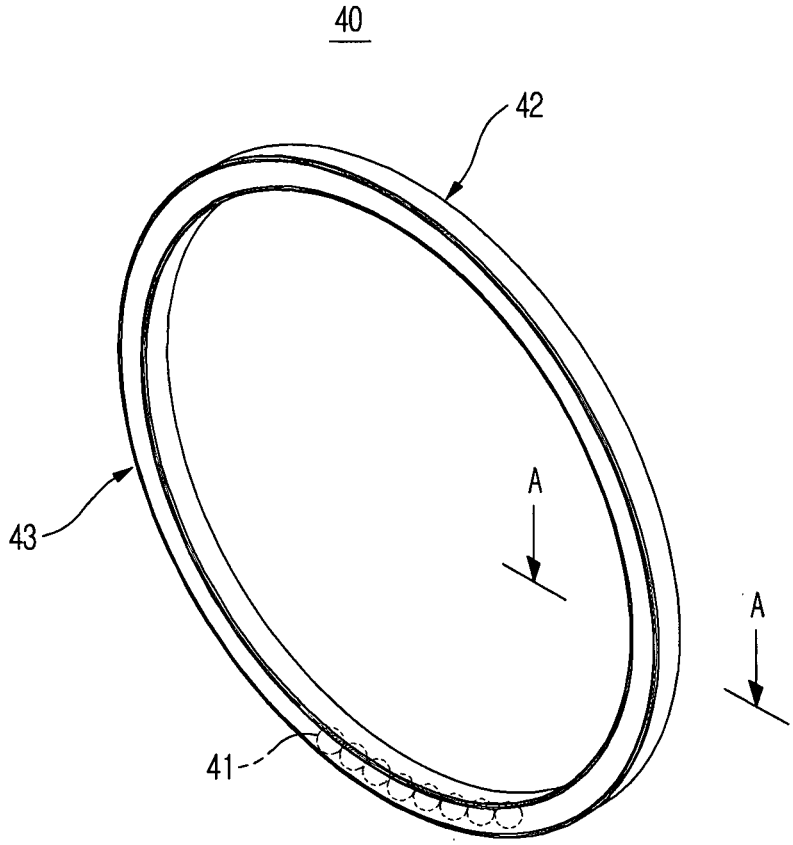
FIG. 8 is a perspective view illustrating an assembled balancer according to the third embodiment of the present invention.
Figure 9:
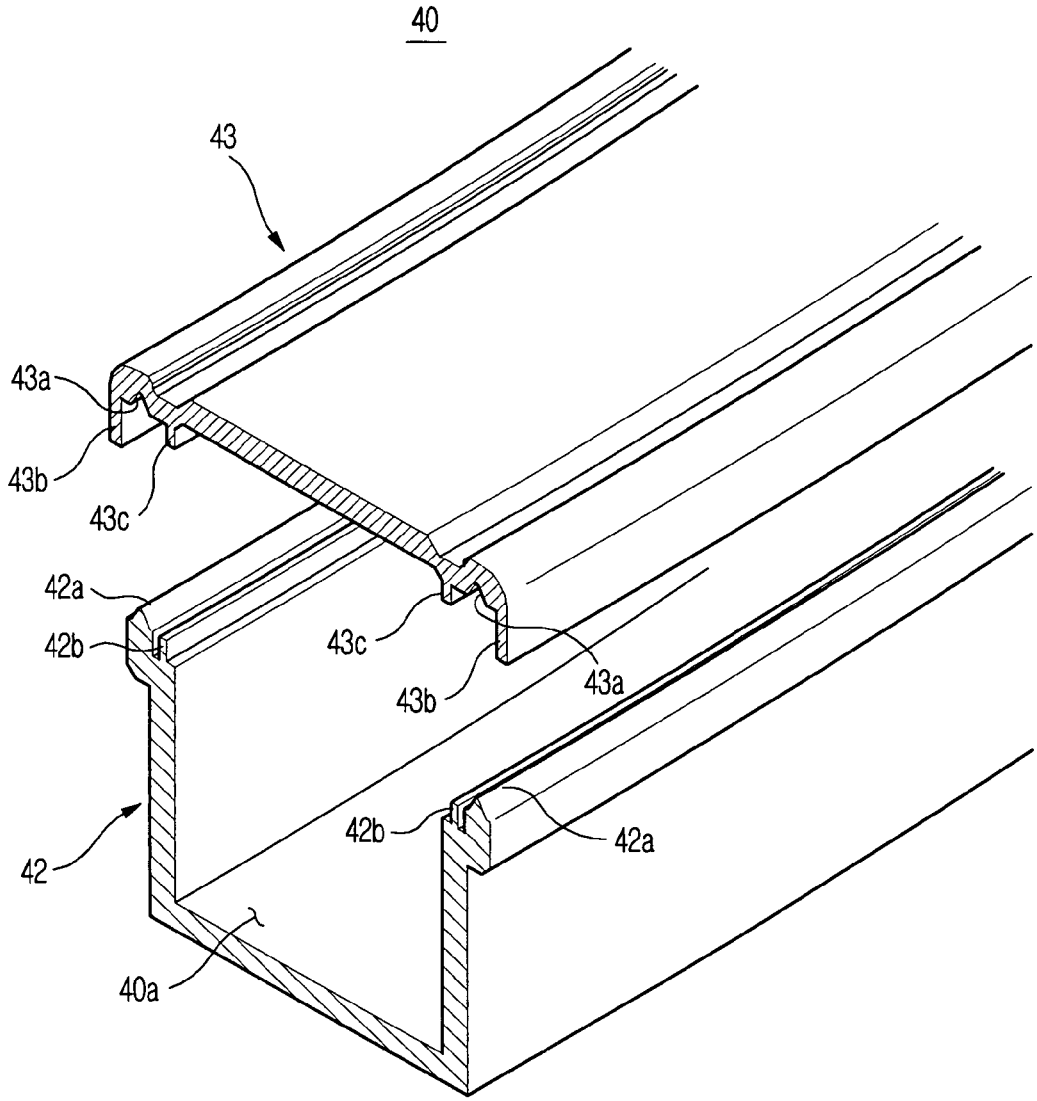
FIG. 9 is a partially enlarged view of FIG. 7.
Figure 10:
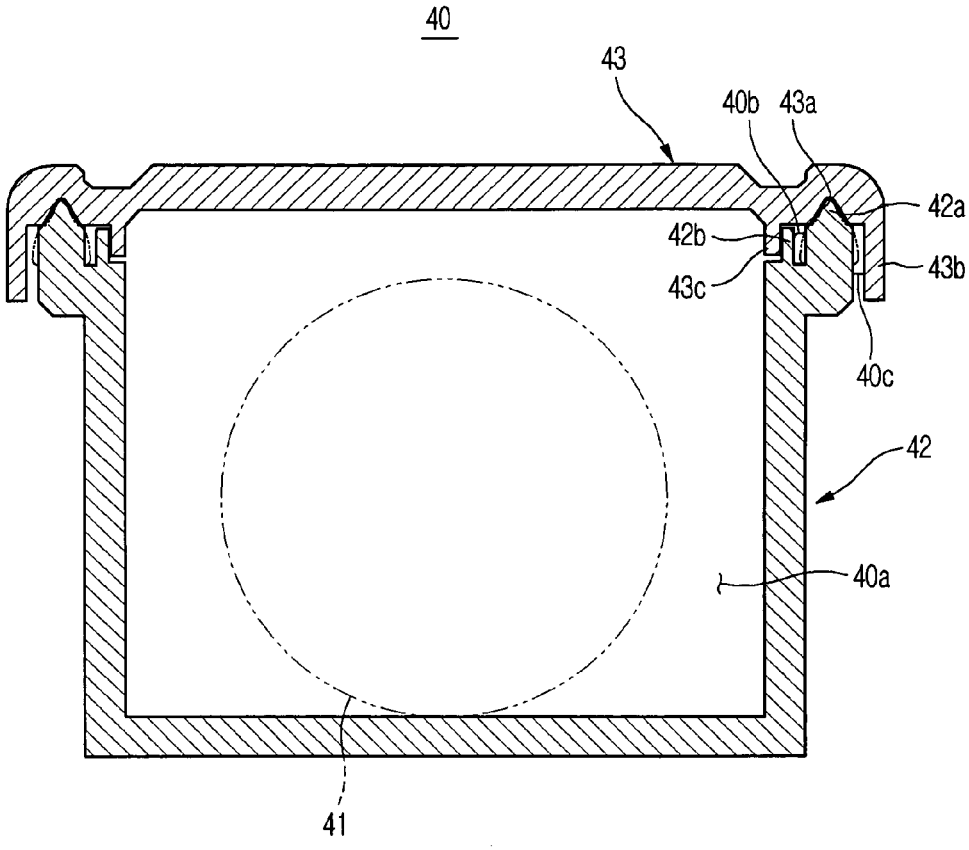
FIG. 10 is a sectional view taken line A-A of FIG. 8.

FIGS. 7 and 8 are perspective views illustrating disassembled and assembled balancers according to the third embodiment of the present invention, FIG. 9 is a partially enlarged view of FIG. 7, and FIG. 10 is a sectional view taken along line A-A of FIG. 8.

As illustrated in FIGS. 7 and 8, a balancer 40 includes a first housing 42 having an annular shape and a second housing 43 having an annular shape that is fused to the first housing 42, thereby forming an annular housing corresponding to the recess 15 (see FIG. 2) of the spin tub 10. The first and second housings 42 and 43 may be, for example, formed of synthetic resin, such as plastic by injection molding.

As illustrated in FIG. 9, the first housing 42 has a cross section of an approximately "C" shape, includes fusion ridges 42*a* protruding to the second housing 43 at opposite ends thereof which are coupled with the second housing 43, and inner pocket ridges 42*b* protruding to the second housing 43 spaced inwardly apart from the fusion ridges 42*a*.

The second housing 43, which is coupled to opposite ends of the first housing 42 in order to form a closed internal space 40*a* for holding a plurality of balls 41 and a viscous fluid, includes fusion grooves 43*a* recessed along edges thereof so as to correspond to the fusion ridges 42*a*, outer pocket flanges 43*b* and guide ridges 43*c*. The outer pocket flanges protrude to the first housing 42 on outer sides of the fusion grooves 43*a* so as to be spaced apart from the fusion ridges 42*a* of the first housing 42 by a predetermined distance. The guide ridges 43*c* protrude to the first housing 42 on inner sides of the fusion grooves 43*a* and closely contact the inner pocket ridges 42*b* of the first housing 42.

The guide ridges 43*c* of the second housing 43 move in contact with the inner pocket ridges 42*b* of the first housing 42 when the second housing 43 is fitted into the first housing 42, to thereby guide the fusion ridges 42*a* of the first housing 42 to be fitted into the fusion grooves 43*a* of the second housing 43 rapidly and precisely.

Thus, when the fusion ridges 42*a* of the first housing 42 are fitted into the fusion grooves 43*a* of the second housing 43 in order to fuse the first housing 42 with the second housing 43, as shown in FIG. 10, an inner pocket 40*b* having a predetermined spacing is formed between the fusion ridges 42*a* and inner pocket ridges 42*b*, and an outer pocket 40*c* having a predetermined spacing is formed between the fusion ridges 42*a* and the outer pocket flanges 43*b*.

In this state, when heat is generated between the fusion ridges 42*a* of the first housing 42 and the fusion grooves 43*a* of the second housing 43, the fusion ridges 42*a* and the fusion grooves 43*a* are firmly fused with each other. At fusion, fusion scraps that are generated by heat and fall down inward of the first housing 42 are collected in the inner pocket 40*b*, so that the scraps are not introduced into the internal space 40*a* of the balancer 40 in which the balls 41 move. Fusion scraps falling down outward of the first housing 42 are collected in the outer pocket 40*c*, and thus are prevented from falling down outward of the balancer 40.

In the embodiments, the balancers 20, 30 and 40 have been described to be installed on a drum type washing machine by way of example, but it is apparent that the balancers can be applied to an upright type washing machine having a structure in which a spin tub is vertically installed.

As described above in detail, the washing machine according to the embodiments of the present invention has a high-strength structure in which at least one balancer is provided with at least one support protruding outward from the wall thereof, so that, although the strong centrifugal force acts on the wall of the balancer due to a plurality of balls making a circular motion in the balancer, the wall of the balancer is not deformed. Thus, the plurality of balls can make a smooth circular motion without causing excess vibration and noise, and thus increasing the durability and life span of the balancer.

Further, the washing machine according to the embodiments of the present invention has a structure in which the balancer can be rapidly and exactly positioned in the recess of the spin tub by the supports, so that an assembly time of the balance can be reduced.

In addition, the washing machine according to the present invention has a structure in which fusion scraps generated when the balancer is fused are collected in a plurality of pockets, and thus are prevented from falling down inward and outward of the balancer, so that the internal space of the balancer, in which a plurality of balls are filled and move in a circular motion, has a smooth surface without the addition of fusion scraps. As a result, the balls are able to move more smoothly, and excess noise and vibration are minimized. The balancer may have a clear outer surface to provide a fine appearance without the fusion scraps, so that it can be exactly coupled to the spin tub without obstruction caused by the fusion scraps.

Although a few embodiments of the present invention have been described for illustrative purposes, those skilled in the art will appreciate that various modifications, additions and substitutions are possible, without departing from the scope and spirit of the invention as disclosed in the accompanying claims and their equivalents.

What is claimed is:

1. A drum type washing machine, comprising:

a housing;

a spin tub to hold laundry to be washed, the spin tub rotating with respect to an axis of the washing machine; and a ball balancer coupled to the spin tub to compensate for a dynamic imbalance during rotation thereof, the ball balancer comprising a first plastic member and a second plastic member joined to each other to form an annular-shaped race having a closed internal space in which a plurality of balls and viscous fluid are accommodated, the first plastic member including a first side wall, a second side wall and a connecting wall to form a three-sided annular-shaped structure having an open side, and the second plastic member configured to cover the open side of the first plastic member, the three-sided annular-shaped structure having a U-shaped cross-section with a first rounded inside corner formed between the first side wall and the connecting wall and a second rounded inside corner formed between the second side wall and the connecting wall, wherein the spin tub includes a cylindrical body, a front cover and a rear cover, the front cover having a front wall with an opening formed therein for receiving laundry and an outer annular side wall establishing continuous circumferential physical contact with a predefined area of an inner surface of the cylindrical body, and the outer annular side wall being an outer wall of an annular recess dimensioned to accommodate the ball balancer therein, whereby during a rotation of the spin tub the ball balancer is supported in a direction of centrifugal force by both the outer annular side wall and the cylindrical body.

2. The drum type washing machine of claim 1, wherein the annular-shaped race is configured such that a radius of curvature of each of the first and second rounded inside corners is greater than a radius of curvature of opposite diagonal inside corners of the annular-shaped race and the radius of curvature of each of the first and second rounded inside corners is less than a radius of curvature of each of the balls, and one of the opposite diagonal inside corners is formed at the second plastic member adjacent to the first side wall of the first plastic member, and another one of the opposite diagonal inside corners is formed at the second plastic member adjacent to the second side wall of the first plastic member.

3. The drum type washing machine of claim 1, wherein the annular-shaped race is configured such that a radius of curvature of each of the first and second rounded inside corners is greater than a radius of curvature of opposite diagonal inside corners of the annular-shaped race and the radius of curvature of each of the first and second rounded inside corners is less than a radius of curvature of each of the balls, and one of the opposite diagonal inside corners is defined at least in part by an inner surface of the second plastic member adjacent to the first side wall of the first plastic member, and another one of the opposite diagonal inside corners is defined at least in part by the inner surface of the second plastic member adjacent to the second side wall of the first plastic member.

4. The drum type washing machine of claim 1, wherein a plurality of supports are formed on an outer surface of the first plastic member to establish contact with the spin tub, each of the supports includes a first support section formed on the first side wall of the first plastic member, the first side wall of the first plastic member defining an outer radial surface of the three-sided annular shaped structure, the first support section configured to contact with a portion of the spin tub.

5. The drum type washing machine of claim 4, wherein each of the supports further includes a second support section extending from the first support section and formed on an outer surface of the connecting wall of the first plastic member.

6. The drum type washing machine of claim 4, wherein the first side wall of the first plastic member includes a first engaging portion to engage with a first portion of the second plastic member, and the second side wall of the first plastic member includes a second engaging portion to engage with a second portion of the second plastic member.

7. The drum type washing machine of claim 6, wherein the first engaging portion includes a first fusion ridge, and the second plastic member is provided with a first fusion groove configured to receive the first fusion ridge.

8. The drum type washing machine of claim 7, wherein the second plastic member includes an outer pocket flange protruding from an outer side of the first fusion groove, and the second plastic member includes a guide ridge which is spaced apart from the outer pocket flange.

9. The drum type washing machine of claim 8, wherein the first engaging portion includes an inner pocket ridge which is spaced apart from the first fusion ridge, the inner pocket ridge configured to engage with the guide ridge of the second plastic member.

10. The drum type washing machine of claim 1, wherein the front cover is configured such that the outer annular side wall defining the annular recess is extended to wrap around a front annular edge of the cylindrical body of the spin tub.

11. The drum type washing machine of claim 1, wherein the ball balancer is arranged with respect to the spin tub such that a first plane of gravitational force applied to the balls is in a non-perpendicular relationship with a second plane of centrifugal force applied to the balls during rotation thereof.

12. The drum type washing machine of claim 1, wherein non-orthogonal inside corners are formed in the annular-shaped race, which are located diagonal to the first and second rounded inside corners.

13. The drum type washing machine of claim 12, wherein the non-orthogonal inside corners are formed in the second plastic member.

14. The drum type washing machine of claim 12, wherein the non-orthogonal inside corners are formed adjacent to joining regions between the first plastic member and the second plastic member.

15. A drum type washing machine, comprising:

a housing;

a spin tub to hold laundry to be washed, the spin tub rotating with respect to an axis of the washing machine; and a ball balancer coupled to the spin tub to compensate for a dynamic imbalance during rotation thereof, the ball balancer comprising a first plastic member and a second plastic member joined to each other to form an annular-shaped race having a closed internal space in which a plurality of balls and viscous fluid are accommodated, the first plastic member including a first side wall, a second side wall and a connecting wall to form a three-sided annular-shaped structure having a first rounded inside corner formed between the first side wall and the connecting wall and a second rounded inside corner formed between the second side wall and the connecting wall, the second plastic member configured to cover an open side of the first plastic member such that non-orthogonal inside corners are formed at locations diagonal to the first and second rounded inside corners, wherein the spin tub includes a cylindrical body, a front cover and a rear cover, the front cover having a front wall with an opening formed therein for receiving laundry and an outer annular side wall establishing continuous circumferential physical contact with a predefined area of an inner surface of the cylindrical body, and the outer annular side wall being an outer wall of an annular recess dimensioned to accommodate the ball balancer therein, whereby during a rotation of the spin tub the ball balancer is supported in a direction of centrifugal force by both the outer annular side wall and the cylindrical body.

16. The drum type washing machine of claim 15, wherein the non-orthogonal inside corners are formed in the second plastic member.

17. The drum type washing machine of claim 15, wherein the non-orthogonal inside corners are formed adjacent to joining regions between the first plastic member and the second plastic member.

* * * * *